US006539902B2

(12) United States Patent
Kadowaki

(10) Patent No.: US 6,539,902 B2
(45) Date of Patent: Apr. 1, 2003

(54) VARIABLE VALVE TIMING CONTROL APPARATUS OF AN INTERNAL COMBUSTION ENGINE

(75) Inventor: Hisashi Kadowaki, Chita-gun (JP)

(73) Assignee: Denso Corporation, Aichi-Pref. (JP)

( * ) Notice: Subject to any disclaimer, the term of this patent is extended or adjusted under 35 U.S.C. 154(b) by 0 days.

(21) Appl. No.: 09/836,357

(22) Filed: Apr. 18, 2001

(65) Prior Publication Data

US 2001/0032605 A1 Oct. 25, 2001

(30) Foreign Application Priority Data

Apr. 24, 2000 (JP) ..... 2000-127614

(51) Int. Cl.[7] ..... F01L 1/34

(52) U.S. Cl. ..... 123/90.15; 123/90.16; 123/90.17

(58) Field of Search ..... 123/90.15, 90.16, 123/90.17, 90.18

(56) References Cited

U.S. PATENT DOCUMENTS 5,042,436 A * 8/1991 Yamamoto ..... 123/90.15
5,184,578 A * 2/1993 Quinn, Jr. ..... 123/90.17
5,289,805 A * 3/1994 Quinn, Jr. ..... 123/90.17
5,398,502 A * 3/1995 Watanabe ..... 60/284
5,469,818 A * 11/1995 Yoshioka et al. ..... 123/90.15
5,562,071 A * 10/1996 Urushihata ..... 123/90.15
5,626,108 A * 5/1997 Kato ..... 123/90.15
5,644,073 A * 7/1997 Matsuno ..... 73/118.1
5,680,834 A * 10/1997 Szpak ..... 123/90.15
5,826,551 A * 10/1998 Janse van Vuuren .... 123/90.12
5,927,252 A * 7/1999 Atsumi ..... 123/406.2
6,170,446 B1 * 1/2001 Hashimoto ..... 123/90.15
6,196,173 B1 * 3/2001 Takahashi et al. ..... 123/90.15
6,250,265 B1 * 6/2001 Simpson ..... 123/90.17

FOREIGN PATENT DOCUMENTS

JP 7-91280 4/1995
JP 10-47135 2/1998

* cited by examiner

*Primary Examiner*—Thomas Denion
*Assistant Examiner*—Jaime Corrigan
(74) *Attorney, Agent, or Firm*—Nixon & Vanderhye PC

(57) ABSTRACT

It is determined whether the current operation condition is in a transitional or steady state. If the operation condition is in a transitional state, then the transition gain is obtained by multiplying the transition base gain that is calculated corresponding to engine speed with a map by a transition degree correction coefficient. If the operation condition is in a steady state, the steady-state gain is set to the steady-state gain that is calculated corresponding to the engine speed. Subsequently, the control magnitude OCVC of the oil pressure control valve is obtained by multiplying the difference between the target advance angle and the actual advance angle by the gain.

20 Claims, 4 Drawing Sheets

VARIABLE VALVE TIMING CONTROL APPARATUS OF AN INTERNAL COMBUSTION ENGINE

CROSS-REFERENCE TO RELATED APPLICATION

The present invention is related to Japanese patent application No. 2000-127614, filed Apr. 24, 2000; the contents of which are incorporated herein by reference.

FIELD OF THE INVENTION

The present invention relates to a variable valve timing control apparatus of an internal combustion engine, and more particularly to a variable valve timing control apparatus for controlling open/close timing (referred to as valve timing below) of intake valves and/or exhaust valves corresponding to the operation condition of an internal combustion engine.

BACKGROUND OF THE INVENTION

Internal combustion engines provided with a variable valve timing mechanism have become popular for improving engine output, saving fuel consumption, and reducing exhaust emission in vehicle internal combustion engines. In general, in a variable valve timing mechanism, engine oil pressure drives the valves. Oil pressure is controlled by an oil pressure control valve to variably control valve timing. Recently, to improve the response of such variable valve timing mechanisms, a variable valve timing control method providing consistent control regardless of the oil pressure is known. Here, oil pressure for driving a variable valve timing mechanism is estimated from oil temperature and engine speed, the target control magnitude of the oil pressure control valve is calculated based on the target advance angle that is set corresponding to the operation condition of the internal combustion engine, the correction gain corresponding to the target control magnitude is calculated corresponding to the oil pressure based on a map, the target control magnitude is corrected based on the correction gain, and the oil pressure control valve is controlled based on the corrected target control magnitude, as shown in Japanese Published Unexamined Patent Application No. Hei 7-91280.

However, the configuration described in the Japanese Published Unexamined Patent Application No. Hei 7-91280 requires a sensor for detecting the oil temperature (or oil pressure), and is resultantly disadvantageous because of the additional cost. Furthermore, though the correction gain is set corresponding to the oil pressure, it is difficult to satisfy both the response in a transitional state and the stability in a steady state. In other words, the stability in a steady state becomes poor if the correction gain is set larger to improve the response in a transitional state. On the other hand, the response in a transitional state becomes poor if the correction gain is set smaller to improve the stability in a steady state.

SUMMARY OF THE INVENTION

In light of these and other drawbacks, the present invention provides a variable valve timing control apparatus for an internal combustion engine that copes with both the response in a transitional state and stability in a steady state of variable valve timing control without additional cost. A variable valve timing control apparatus of an internal combustion engine sets a target advance angle of the valve timing corresponding to the operation condition of the internal combustion engine with a target advance angle setting means, determines the transitional or steady state operation condition with a transitional/steady state determining means when the valve timing is feedback-controlled to the target advance angle with a feedback control means, and variably sets the feedback gain of the feedback control based on the determination result obtained by a feedback gain variable means. Thereby, the feedback gain can be switched to the proper gain between transitional and steady states, and both the response in a transitional state and the stability in a steady state of the variable valve timing control are simultaneously satisfied. The throttle opening and intake air flow (or intake pipe pressure) detected by a sensor mounted on an engine control system are used to determine whether the operation condition is transitional or steady state. Therefore, an additional sensor is not required.

Furthermore, the target advance angle may be variably set based on the transitional or steady state determination result with a target advance angle variable means.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE INVENTION

Figure 1:
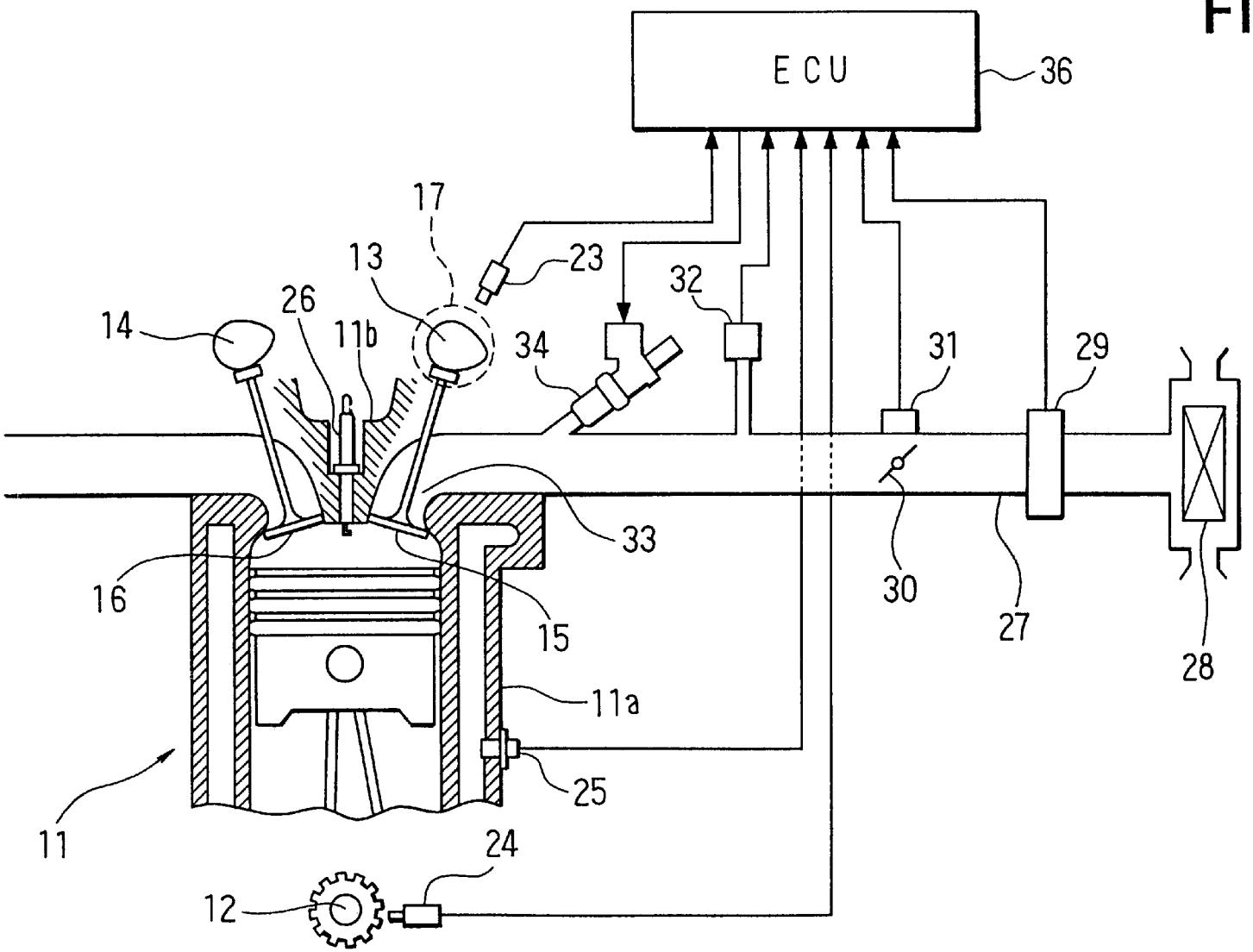
FIG. 1 is a partial cross-sectional view of the present invention.

A first embodiment, shown in FIG. 1 to FIG 4, includes DOHC engine that drives crankshaft 12. Crankshaft 12, in turn, drives intake camshaft 13 and exhaust camshaft 14 through a timing chain (not shown), Camshaft 13 and 14 open/close-drive intake valve 15 and exhaust valve 16. The intake camshaft 13 is provided with an oil pressure driven variable valve timing mechanism 17 for adjusting the advance angle of the intake camshaft with respect to the crankshaft 12. A camshaft sensor 23 is provided near the intake camshaft 13, and a crankshaft sensor 24 is provided near the crankshaft 12.

In this case, the crankshaft sensor 24 generates N crankshaft phase detection pulse signals per one turn of the cranks shaft 12. On the other hand, the camshaft sensor 23 generates 2N camshaft phase detection pulse signals per one turn of the intake camshaft 13. The number of crankshaft phase detection pulse signals N is set as N<360/.max, wherein .max°CA denotes the maximum advance angle of the intake camshaft 13. Thereby, the actual valve timing (actual advance angle of the intake camshaft 13) of the intake valve 15 is calculated based on the phase difference between the phase of a crankshaft phase detection pulse signal supplied from the crankshaft 24 and the phase of the next coming camshaft phase detection pulse signal supplied from the intake camshaft sensor 23.

A cooling water temperature sensor 25 is attached to a cylinder block 11*a* of the engine 11. A spark plug 26 is attached to each cylinder of a cylinder head 11*b*. Air cleaner 28 is provided all the way up stream from the intake pipe 27. An air flow meter 29 for detecting intake air flow is provided down stream from air cleaner 28. A throttle valve 30 is provided downstream of the air flow meter 29, and the opening (throttle opening) of the throttle valve 30 is detected with the throttle sensor 31. An intake pipe pressure sensor 32 for detecting the intake pipe pressure is provided downstream of the throttle valve 30. Furthermore, a fuel injection valve 34 is attached near an intake port 33 of each cylinder.

The outputs of the various sensors are supplied to an engine control circuit (referred to as ECU below) 36. The ECU 36 has a microcomputer, and executes a VVT control program shown in FIG. 2 to control the valve timing (referred to as VVT control below). During the VVT control, the ECU 36 operates the actual advance angle VVTA (actual valve timing) of the intake valve 15 based on the detection pulse signal supplied from the crankshaft sensor 24 and camshaft sensor 23, operates the target advance angle VVTT (target valve timing) of the intake valve 15 based on various sensor outputs for detecting the engine operation condition, controls the oil pressure control valve (not shown in the drawing) so that the actual advance angle VVTA is equalized to the target advance angle VVTT to thereby feedback-control the oil pressure for driving the variable valve timing mechanism 17.

Furthermore, the ECU 36 determines whether the engine operation condition is in a transitional or steady state with the oil pressure control valve control magnitude calculation program shown in FIG. 3 when the control magnitude OCVC of the oil pressure control valve is calculated, and variably sets the feedback gain of the VVT control (referred to as F/B gain below in abbreviation) corresponding to the determination result, and calculates the control magnitude OCVC of the oil control valve by use of the F/B gain. The processing contents of these programs will be described below.

Figure 2:
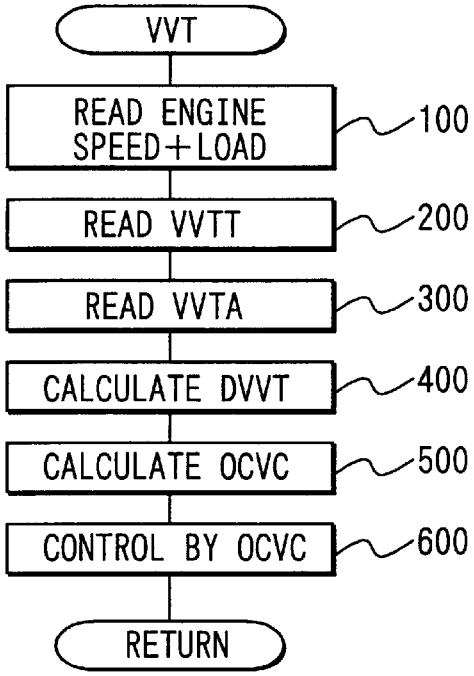
FIG. 2 is a flow chart describing process flow of a VVT control program in the present invention.

The VVT control program shown in FIG. 2 is activated every predetermined time period or every predetermined crank angle, and acts as a feedback control means. When the program is activated, at first the engine speed Ne and the engine load (for example, intake air flow, intake air pipe pressure, throttle opening or the like) are read in at step 100, and the target advance angle VVTT is calculated corresponding to the current engine speed Ne and the engine load from the map or the like in the next step 200. The processing in the step 200 acts as a target advance angle setting means.

Thereafter, the sequence proceeds to the step 300 and the actual advance angle VVTA of the intake valve 15 is detected based on the phase difference between the phase of the crankshaft phase detection pulse signal supplied from the crankshaft sensor 24 and the phase of the camshaft phase detection pulse signal supplied from the intake camshaft sensor 23. Subsequently, the sequence proceeds to the step 400, the difference DVVT (=VVTT−VVTA) between the target advance angle VVTT and the actual advance angle VVTA is calculated. In the next step 500, the oil pressure control valve control magnitude calculation program shown in FIG. 3 is executed to thereby calculate the control magnitude OCVC of the oil pressure control valve. Subsequently, the sequence proceeds to the step 600, and the oil pressure for driving the variable valve timing mechanism 17 is controlled by controlling the oil pressure control valve based on the control magnitude OCVC so that the actual advance angle VVTA is equalized to the target advance angle VVTT.

Figure 3:
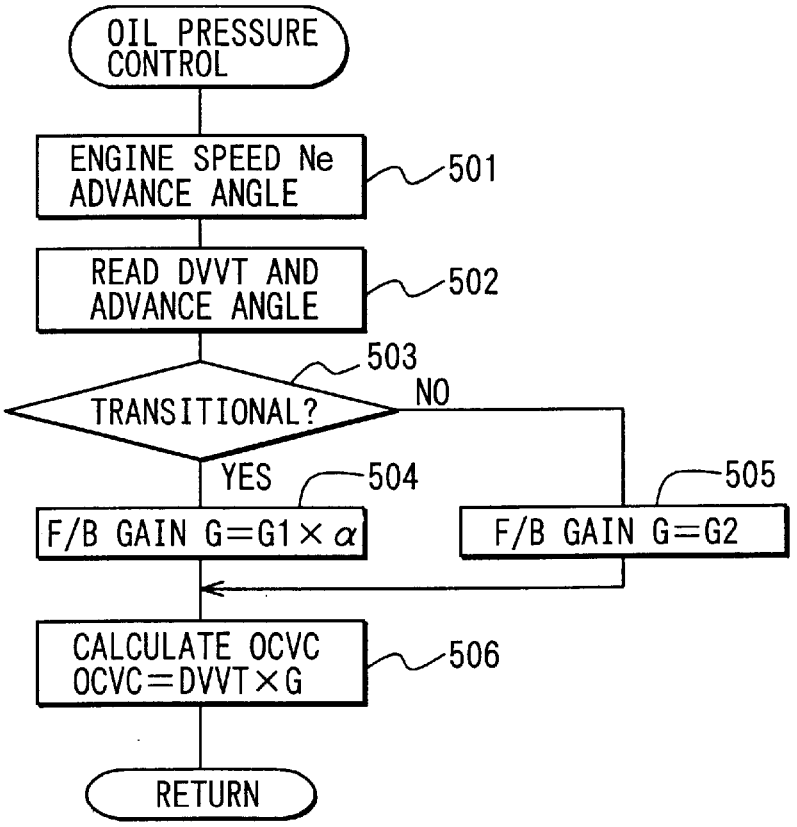
FIG. 3 is a flow chart describing a process flow of an oil pressure control valve control magnitude calculation program in the present invention.

On the other hand, when the oil pressure control valve control magnitude calculation program shown in FIG. 3 is activated in step 500, at first the engine speed Ne is read in the step 501, and the advance angle difference DVVT (=VVTT−VVTA) that has been calculated in step 400 in the VVT control program shown in FIG. 2 is read in the next step 502. Subsequently, the sequence proceeds to step 503, and whether the current operation condition is in a transitional state is determined by any of the methods described below.

Transition Determining Method 1

If the change of throttle opening per unit time is equal to or larger than a predetermined value, the operation condition is determined to be transitional. At that time, a larger throttle opening change per unit time may be determined as transitional.

Transition Determining Method 2

If the intake air flow change (or intake pipe pressure change) per unit time is equal to or larger than a predetermined value, the operation condition is determined to be transitional. At that time, the larger change of intake air flow change (or intake pipe pressure change) per unit time may be determined to be transitional.

Transition Determining Method 3

In the case that the target advance angle VVTT change per unit time is equal to or larger than a predetermined value, the operation condition is determined to be transitional. At that time, the larger change of the target advance angle VVTT change per unit time may be determined to be transitional.

Otherwise, two or three transition determining methods out of the three transition determining methods are used together. The operation condition is determined to be transitional if any one determination condition is satisfied. Or, The operation condition can determined to be transitional if two or more determination conditions are satisfied simultaneously. The processing in the step 503 corresponds to a transitional/steady state determining means.

If the operation condition is determined to be transitional in the step 503, then the sequence proceeds to the step 504, and the transition F/B gain G is calculated according to the following equation by use of the transition base F/B gain G1 and transition degree correction coefficient ALPHA.

$$G=G1\times ALPHA$$

Figure 4A:
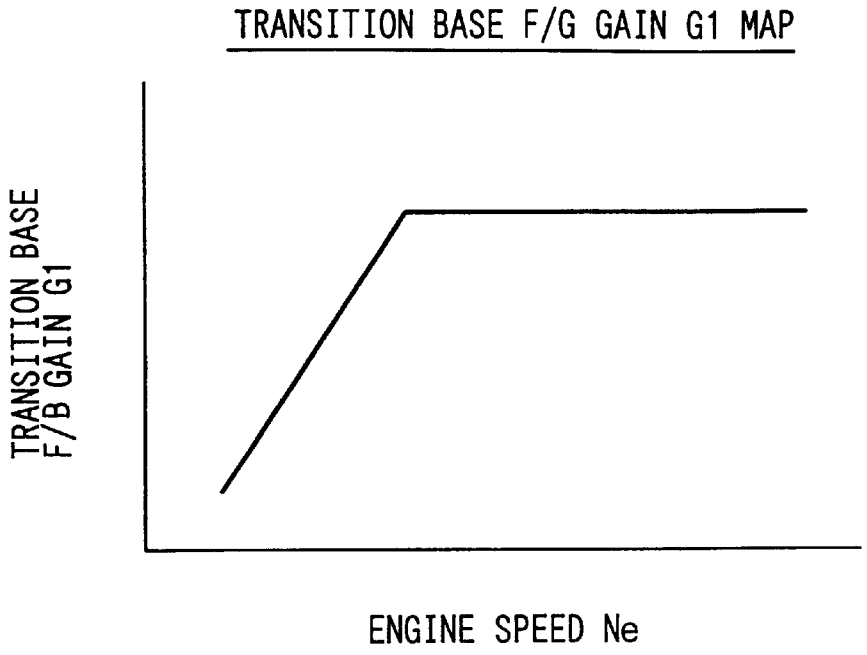
FIG. 4A is a schematic diagram describing a calculation map of the transition base F/B gain G1 of the present invention.

Herein, the transition base F/B gain G1 is calculated corresponding to the engine speed Ne by use of a map shown in FIG. 4A. The transition base F/B gain G1 is set relatively larger than the steady-state F/B gain G2 shown in FIG. 4B. The transition degree correction coefficient ALPHA is used to correct the transition base F/B gain G1 corresponding to the transition degree. The value of the transition degree correction coefficient ALPHA is larger as the transition degree becomes larger. Thereby, the transition F/B gain G is set to a larger value as the transition degree becomes larger.

Figure 4B:
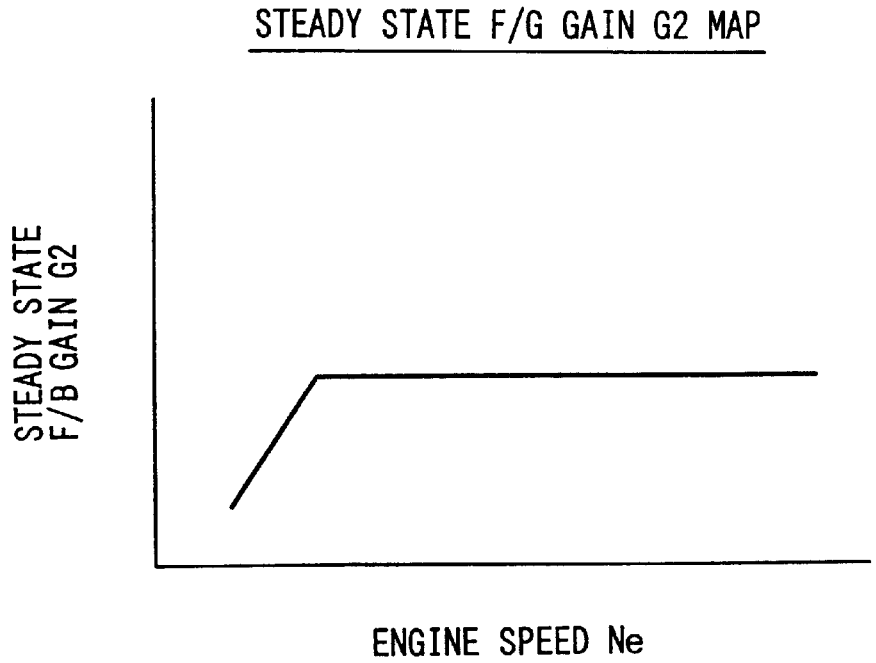
FIG. 4B is a schematic diagram for describing a calculation map of the steady-state F/B gain G2 of the invention.

On the other hand, if the operation condition is determined to be steady-state in step 503, the sequence proceeds to step 505, and the steady-state F/B gain G is set to the steady-state F/B gain G2 calculated corresponding to the engine speed Ne from the map shown in FIG. 4B. The processing in the steps 504 and 505 act as the feedback gain variable means.

After the F/B gain G corresponding to the steady-state is calculated in the step 504 or 505, the sequence proceeds to the step 506. Here, the control magnitude OCVC of the oil pressure control valve is calculated by multiplying the advance angle difference DVVT by F/B gain G, and the program is brought to an end.

$$OCVC=DVVT\times G$$

The oil pressure control valve is controlled based on the control magnitude OCVC, and the oil pressure for driving the variable valve timing mechanism 17 is thereby controlled so that the actual advance angle VVTA is equalized to the target advance angle VVTT.

As described above, according to the embodiment 1, because the F/B gain G of the VVT control is set variable corresponding to transitional or steady state operation, the control magnitude OCVC of the oil pressure valve is variably set corresponding to the transitional or steady state operation, and both the response in a transitional state and the stability in a steady state of the VVT control are satisfied. Furthermore, because the throttle opening, intake air flow (or intake pipe pressure), or target advance-angle, which is detected by means of a sensor mounted on an engine control system generally, may be used as the information used for transitional or steady state determination, an additional sensor and concomitant additional cost are not required.

Furthermore, in embodiment 1, because the F/B gain can be set variably corresponding to the transition degree in a transitional state by using the transition degree correction coefficient ALPHA, the response of the VVT control can be adjusted to the optimal condition (the response is quickened where overshoot is not excessive) corresponding to the transition degree. Thus, the response of the VVT control and convergence to the target advance angle are both satisfied. Also, in the present invention, the F/B gain may be a fixed value during a transitional state.

Further, the steady-state F/B gain G (=G2) can be used as a reference F/B gain when the F/B gain G is set variably corresponding to the transitional or steady state. The reference F/B gain is multiplied by the correction value, or the correction value is added to the reference F/B gain in a transitional state to obtain the F/B gain G in the transitional state. At that time, the correction value may be fixed, or may be larger as the transition degree becomes larger.

Embodiment 2

In the embodiment 1, the F/B gain of the VVT control is set variably corresponding to a transitional or steady state. On the other hand, in the embodiment 2 of the present invention shown in FIG. 5 and FIG. 6, the target advance angle VVTT is set variably corresponding to the transitional or steady state (the F/B gain is not variable).

Figure 5:
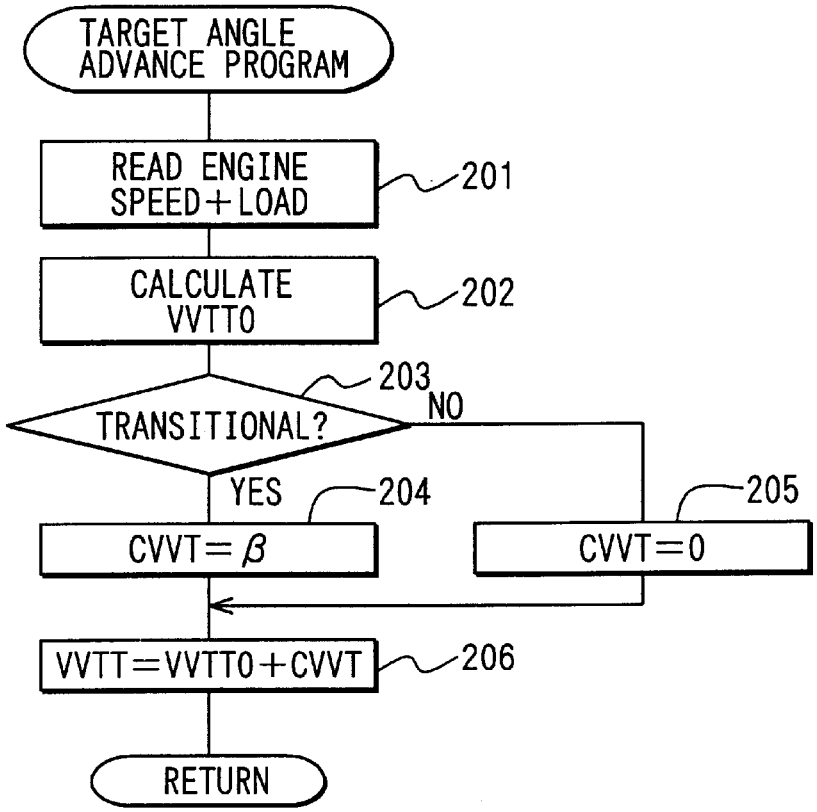
FIG. 5 is a flow chart for describing the process flow of the target advance angle calculation program in the invention.
Figure 6:
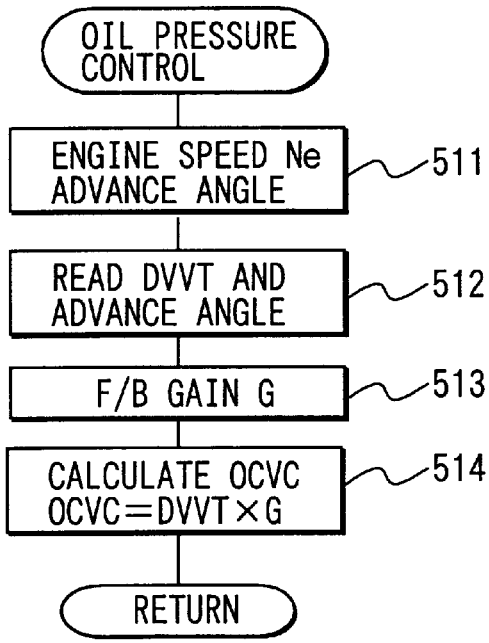
FIG. 6 is a flow chart for describing the process flow of the oil pressure control valve control magnitude calculation program in the invention.

In embodiment 2, the VVT control program is used as the main program of the VVT control, the target advance angle calculation program shown in FIG. 5 is executed in step 200 to set variably the target advance angle VVTT corresponding to a transitional or steady state, and the oil pressure control valve control magnitude calculation program shown in FIG. 6 is executed in step 500 to calculate the control magnitude OCVC of the oil pressure control valve. Other processing and system structure are the same as those described in the embodiment 1.

In the target advance angle calculation program shown in FIG. 5, the engine speed Ne and engine load (for example, intake air flow, intake pipe pressure, throttle opening) detected by respective sensors are first read in step 201, and in the next step 202 the reference target advance angle VVTTO is calculated based on the engine speed Ne and the engine load by use of a map. The reference target advance angle VVTTO is set to a value equivalent to the target advance angle VVTT in a steady state.

Subsequently, the sequence proceeds to step 203, and whether the current operation condition is in a transitional or steady state in the same manner as used in the embodiment 1 is determined. If the operation condition is determined to be transitional in step 203, then the sequence proceeds to step 204. Then, the correction magnitude CVVT corresponding to the reference target advance angle VVTTO in a transitional state is set to the correction magnitude BETA calculated by use of the map corresponding to the transition degree. Otherwise, BETA may be a fixed value. On the other hand, if the operation condition is determined to be steady-state in step 203, then the sequence proceeds to step 205. The correction magnitude CVVT corresponding to the reference target advance angle VVTTO in a steady state is set to 0 (no correction). After the target advance angle correction magnitude CVVT corresponding to the transitional or steady state is calculated in step 204 or 205, the sequence proceeds to step 206. Here, the target advance angle VVTT is calculated by adding the correction magnitude CVVT to the reference target advance angle VVTTO, and the program ends.

$$VVTT=VVTTO+CVVT$$

The processing in steps 204 to 206 acts as the target advance angle variable means. In the program shown in FIG. 5, the target advance angle correction magnitude CVVT is added to the reference target advance angle magnitude VVTTO. However, the reference target advance angle magnitude VVTTO may be multiplied by the target advance angle correction magnitude CVVT (VVTT=VVTTO× CVVT). In this case, the target advance angle correction magnitude CVVT in a steady state is 1 (no correction).

Furthermore, two maps, namely a transition map and a steady-state map are used as the map of the target advance angle VVTT. The transition map is used to calculate the transition target advance angle VVTT in a transitional state, and the steady-state map is used to calculate the steady-sate target advance angle VVTT.

On the other hand, in the oil pressure control valve control magnitude calculation program shown in FIG. 6, the engine speed Ne is read in step 511 at first. In the next step 512, the advance angle difference DVVT (=VVTT−VVTA) calculated in step 400 of the VVT control program shown in FIG. 2 is read. Subsequently, the sequence proceeds to the step 513, the F/B gain G is calculated corresponding to the engine speed Ne by use of the map. The F/B gain G is set to a value equivalent to the steady-state F/B gain G2 shown in FIG. 4B. Subsequently, the sequence proceeds to the step 514, the control magnitude OCVC of the oil pressure control valve is obtained by multiplying the advance angle difference DVVT by F/B gain G, and the program is brought to an end.

$$OCVC=DVVT \times G$$

In this case, because the target advance angle VVTT is set variably corresponding to the transitional or steady state by the target advance angle calculation program shown in FIG. 5, the advance angle difference DVVT changes corresponding to the transitional or steady state. Thereby, the control magnitude OCVC of the oil pressure control valve is variably set properly corresponding to the transitional or steady state as in the case of the embodiment 1, and both the response in a transitional state and the stability in a steady state are satisfied simultaneously.

In both embodiments 1 and 2, the case in which the present invention is applied to a system having a variable valve timing mechanism for an intake valve is described, however, the present invention may be applied to a system having a variable valve timing mechanism for an exhaust valve similarly.

While the above-described embodiments refer to examples of usage of the present invention, it is understood that the present invention may be applied to other usage, modifications and variations of the same, and is not limited to the disclosure provided herein.

What is claimed is:

1. A variable valve timing control apparatus of an internal combustion engine for controlling valve timing of an intake valve or an exhaust valve corresponding to an operation condition of the internal combustion engine comprising:

a target advance angle setting means for setting a valve timing target advance angle corresponding to the operation condition of the internal combustion engine;

a feedback control means for feedback-controlling the valve timing to the target advance angle;

a transitional/steady state determining means for determining whether the operation condition of the internal combustion engine is in a transitional or steady state; and a feedback gain variable means for variably setting the feedback gain of the feedback control based on a determination result from the transitional/steady state determining means;

wherein the transitional/steady state determining means determines the transitional or steady state based on a throttle opening change per unit time.

2. The variable valve timing control apparatus according to claim 1, wherein the feedback gain variable means switches the feedback gain between a steady-state and transition mode, said feedback gain variable means variably setting the feedback gain corresponding to a transition degree when in a transitional state.

3. A variable valve timing control apparatus of an internal combustion engine for controlling valve timing of an intake valve or exhaust valve corresponding to an operation condition of the internal combustion engine comprising:

a target advance angle setting means for setting a target advance angle of the valve timing corresponding to the operation condition of the internal combustion engine;

a feedback control means for feedback-controlling the valve timing to the target advance angle;

a transitional/steady state determining means for determining whether the operation condition of the internal combustion engine is in a transitional or steady state; and a target advance angle variable means for variably setting the target advance angle based on a determination result obtained from the transitional/steady state determining means;

wherein the transitional/steady state determining means determines the transitional or steady state based on a throttle opening change per unit time.

4. The variable valve timing control apparatus according to claim 3, wherein the target advance variable means variably sets the target advance angle corresponding to a transition degree when in a transitional state.

5. A method for controlling valve timing in an internal combustion engine, comprising:

determining a valve timing target advance angle based on an operation condition of the internal combustion engine;

determining whether the operation condition is in a transitional state or steady state;

controlling the valve timing to the target advance angle by a first gain factor if the operation condition is in a steady state; and controlling the valve timing by a second gain factor if the operation condition is in the transitional state;

wherein the second gain factor is greater than the first gain factor and said second gain factor increases a valve timing responsiveness greater than the first gain factor.

6. The method for controlling valve timing as claimed in claim 5, wherein the operation condition of the internal combustion engine is determined to be in either the transitional state or steady state by at least an engine speed or an air intake flow.

7. The method for controlling valve timing as claimed in claim 5, wherein said valve timing is controlled by increasing an oil pressure supplied to valves of said internal combustion engine.

8. The method for controlling valve timing as claimed in claim 7, wherein said valves are intake valves.

9. The method for controlling valve timing as claimed in claim 7, wherein said valves are exhaust valves.

10. A variable valve timing control apparatus of an internal combustion engine for controlling valve timing of an intake valve or an exhaust valve corresponding to an operation condition of the internal combustion engine comprising:

a target advance angle setting means for setting a valve timing target advance angle corresponding to the operation condition of the internal combustion engine;

a feedback control means for feedback-controlling the valve timing to the target advance angle;

a transitional/steady state determining means for determining whether the operation condition of the internal combustion engine is in a transitional or steady state; and a feedback gain variable means for variably setting the feedback gain of the feedback control based on a determination result from the transitional/steady state determining means;

wherein the transitional/steady state determining means determines the transitional or steady state based on an intake air flow change or intake pipe pressure change per unit time.

11. The variable valve timing control apparatus according to claim 10, wherein the feedback gain variable means switches the feedback gain between a steady-state and transition mode, said feedback gain variable means variably setting the feedback gain corresponding to a transition degree when in a transitional state.

12. A variable valve timing control apparatus of an internal combustion engine for controlling valve timing of an intake valve or exhaust valve corresponding to an operation condition of the internal combustion engine comprising:

a target advance angle setting means for setting a target advance angle of the valve timing corresponding to the operation condition of the internal combustion engine;

a feedback control means for feedback-controlling the valve timing to the target advance angle;

a transitional/steady state determining means for determining whether the operation condition of the internal combustion engine is in a transitional or steady state; and a target advance angle variable means for variably setting the target advance angle based on a determination result obtained from the transitional/steady state determining means;

wherein the transitional/steady state determining means determines the transitional or steady state based on an intake air flow change or intake pipe pressure change per unit time.

13. The variable valve timing control apparatus according to claim 12, wherein the target advance variable means variably sets the target advance angle corresponding to a transition degree when in a transitional state.

14. A variable valve timing control apparatus of an internal combustion engine for controlling valve timing of an intake valve or an exhaust valve corresponding to an operation condition of the internal combustion engine comprising:

a target advance angle setting means for setting a valve timing target advance angle corresponding to the operation condition of the internal combustion engine;

a feedback control means for feedback-controlling the valve timing to the target advance angle;

a transitional/steady state determining means for determining whether the operation condition of the internal combustion engine is in a transitional or steady state; and a feedback gain variable means for variably setting the feedback gain of the feedback control based on a determination result from the transitional/steady state determining means;

wherein the transitional/steady state determining means determines the transitional or steady state based on a target advance angle change per unit time.

15. The variable valve timing control apparatus according to claim 14, wherein the feedback gain variable means switches the feedback gain between a steady-state and transition mode, said feedback gain variable means variably setting the feedback gain corresponding to a transition degree when in a transitional state.

16. A variable valve timing control apparatus of an internal combustion engine for controlling valve timing of an intake valve or exhaust valve corresponding to an operation condition of the internal combustion engine comprising:

a target advance angle setting means for setting a target advance angle of the valve timing corresponding to the operation condition of the internal combustion engine;

a feedback control means for feedback-controlling the valve timing to the target advance angle;

a transitional/steady state determining means for determining whether the operation condition of the internal combustion engine is in a transitional or steady state; and a target advance angle variable means for variably setting the target advance angle based on a determination result obtained from the transitional/steady state determining means, wherein the transitional/steady state determining means determines the transitional or steady state based on a target advance angle change unit per time.

17. The variable valve timing control apparatus according to claim 16 wherein the target advance variable means variably sets the target advance angle corresponding to a transition degree when in a transitional state.

18. A variable valve timing control apparatus of an internal combustion engine for controlling valve timing of an intake valve or an exhaust valve corresponding to an operation condition of the internal combustion engine comprising:

a target advance angle setting means for setting a valve timing target advance angle corresponding to the operation condition of the internal combustion engine;

a feedback control means for feedback-controlling the valve timing to the target advance angle;

a transitional/steady state determining means for determining whether the operation condition of the internal combustion engine is in a transitional or steady state; and a feedback gain variable means for variably setting the feedback gain of the feedback control based on a determination result from the transitional/steady state determining means;

wherein the feedback control means includes a control amount calculating means for calculating a control amount for operating an actual advance angle to the target advance angle based on a difference angle between the actual advance angle and the target advance angle and the feedback gain.

19. The variable valve timing control apparatus according to claim 18, wherein the control amount is calculated by multiplying the difference angle and the feedback gain.

20. The variable valve timing control apparatus according to claim 18, wherein the feedback gain variable means switches the feedback gain between a steady-state and transition mode, said feedback gain variable means variably setting the feedback gain corresponding to a transition degree when in a transitional state.

* * * * *